US012611058B1

(12) United States Patent
Cooper

(10) Patent No.: US 12,611,058 B1
(45) Date of Patent: Apr. 28, 2026

(54) BODY-ENCOMPASSING BLANKET

(71) Applicant: Jessica Cooper, Wallops Island, VA (US)

(72) Inventor: Jessica Cooper, Wallops Island, VA (US)

( * ) Notice: Subject to any disclaimer, the term of this patent is extended or adjusted under 35 U.S.C. 154(b) by 24 days.

(21) Appl. No.: 18/515,851

(22) Filed: Nov. 21, 2023

(51) Int. Cl.
*A47G 9/06* (2006.01)
*A41D 7/00* (2006.01)

(52) U.S. Cl.
CPC ..... *A47G 9/064* (2013.01); *A41D 7/006* (2013.01)

(58) Field of Classification Search
CPC ..... A41D 7/00; A41D 7/006; A41D 7/008; A41D 1/22; A41D 3/08; A47G 9/064; A47G 9/066
See application file for complete search history.

(56) References Cited

U.S. PATENT DOCUMENTS 2,140,797 A * 12/1938 Hammerman ..... A47D 15/008 2/114
2,676,319 A * 4/1954 Davidson ..... G21F 3/02 2/84
7,752,690 B1 * 7/2010 Seth ..... A47G 9/086 5/413 R
8,464,374 B1 * 6/2013 Thayer ..... A45F 4/12 5/413 R
8,578,525 B1 * 11/2013 Seth ..... A47G 9/086 5/413 R
10,117,471 B2 * 11/2018 Nam ..... D04B 7/34
D839,539 S 2/2019 Jones
D839,546 S 2/2019 Noiberg
D861,289 S 10/2019 Ngan
D894,532 S 9/2020 Ngan
D968,051 S 11/2022 Speciale et al.
D968,759 S 11/2022 Speciale et al.
2003/0079270 A1 * 5/2003 Bailey ..... A41B 13/06 2/69.5
2010/0071110 A1 * 3/2010 Stevens ..... A41D 27/20 2/69
2010/0186166 A1 * 7/2010 Sulentic ..... A41D 13/08 5/482
2014/0317824 A1 10/2014 Browning et al.
2017/0311655 A1 11/2017 Gonzalez
2018/0368496 A1 12/2018 Berrebi
2023/0097271 A1 3/2023 Zlotkin

* cited by examiner

*Primary Examiner* — Jameson D Collier
(74) *Attorney, Agent, or Firm* — Cramer Patent & Design, PLLC.; Aaron R. Cramer

(57) ABSTRACT

A body-encompassing blanket includes a lower panel configured to cover the front of a user's lower body, an upper front panel divided into two parts forming sleeves, and a back panel extending from a waist opening toward an upper back region. A rear leg panel is attached to the lower panel to define a pocket that encloses the lower legs and feet of the user. The waist opening facilitates entry and exit and includes adjustable closure fasteners. Arm openings allow access to the sleeves, and hems and interior seams incorporate clean-finish stitching and overlock reinforcement. The blanket provides warmth, mobility, and a comfortable, non-restrictive fit suitable for seated or reclined use.

2 Claims, 6 Drawing Sheets

BODY-ENCOMPASSING BLANKET

RELATED APPLICATIONS

None.

FIELD OF THE DEVICE

This device relates to the field of personal comfort and textile products, specifically a body-encompassing blanket designed for enhanced warmth and convenience.

BACKGROUND OF THE DEVICE

Traditional blankets, while offering warmth, often restrict movement and do not provide a secure fit, especially when the user is seated or moving. There has been a noticeable gap in the market for a blanket that not only provides the necessary warmth but also allows for greater flexibility and ease of use. Existing designs typically do not offer features that accommodate activities such as reading, watching television, or other seated tasks without compromising warmth or comfort. This device addresses these shortcomings by introducing a novel body-encompassing blanket design. It combines the warmth of traditional blankets with the functionality of a garment, featuring integrated sleeves, a waist opening, and a rear leg panel, ensuring both mobility and comfort. This innovative approach fulfills a need in the market for a more practical and versatile blanket suitable for various indoor and outdoor settings.

SUMMARY OF THE DEVICE

Embodiments of the present disclosure may include a body-encompassing blanket, which consists of several integral components designed for enhanced comfort and functionality. The blanket features a lower panel that serves as the primary covering for the lower part of a user's body. Additionally, an upper front panel is included, which is split into two parts extending upwards to form loose-fit sleeves.

The design incorporates a back panel that extends from a waist opening to the upper back, seamlessly connecting to the upper front panel. A rear leg panel, emanating from the lower panel, forms a pocket specifically for encasing the lower legs of the user. A strategically located waist opening, positioned between the lower and back panels, facilitates easy entry and exit for the user, and is accompanied by a pair of arm openings in the upper front panel for the user's arms.

For adjustability and comfort, the blanket includes a closure mechanism integrated into the waist opening. This feature is designed for adjusting the fit around the user's waist. Furthermore, the blanket is characterized by a plurality of hem finishes along all panel edges and overlock stitching on the interior seams of the lower panel side seams and sleeves, enhancing the blanket's durability.

In certain embodiments, the textile used for the blanket may comprise natural fibers, synthetic fibers, or a blend of both. The blanket is customizable in various sizes, colors, and styles, accommodating a broad range of users from children to adults. The lower panel of the blanket is distinguished by side seams with overlocking stitching for structural integrity and a lower seam with a clean finish box cut at the hem, adding both aesthetic appeal and durability. The sleeves are designed for a loose fit, promoting ease of movement, and include overlock stitching on the interior seams for added reinforcement.

The closure means for the blanket may vary, including options such as buttons, snaps, hook-and-loop fasteners, or other adjustable and secure fastening systems. This feature enables size adjustment of the waist opening to suit different body types.

A method for utilizing the body-encompassing blanket is also disclosed, involving a series of steps for optimal use. Initially, the blanket is placed in a flat, planar configuration. The user then steps through the waist opening to drape the blanket over their body, pulls the back panel over their shoulders, and aligns the upper front panels. The user inserts their arms through the sleeves via the arm openings, positions the lower panel and rear leg panel to encase the lower body and legs within the formed pocket, and utilizes the closure means to adjust the fit at the waist. This ensures a comfortable, non-restrictive fit suitable for activities such as sitting or reclining. Lastly, the blanket can be easily removed, folded, and maintained for repeated use.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
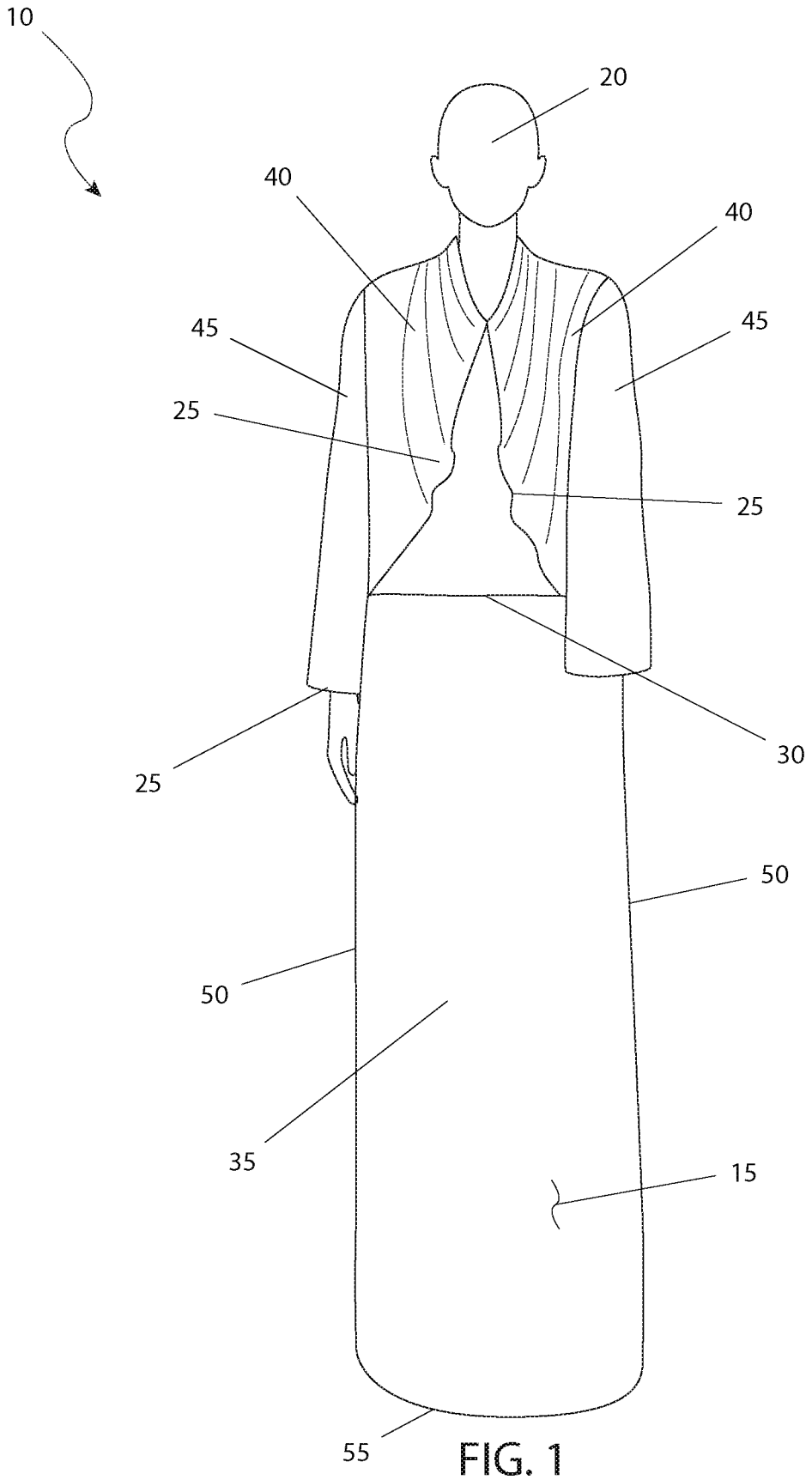
FIG. 1 is a front view of a body-encompassing blanket 10, shown in a utilized state, according to the preferred embodiment of the present device.

10 body-encompassing blanket
15 textile
20 user
25 hem
30 waist opening
35 lower panel
40 upper front panel
45 sleeve
50 lower panel side seam
55 lower panel lower seam
60 back panel
65 rear leg panel
70 pocket
75 closure means
80 arm opening

DESCRIPTION OF THE PREFERRED EMBODIMENTS

The best mode for carrying out the device is presented in terms of its preferred embodiment, herein depicted within FIGS. 1 through 6. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the body-encompassing blanket 10, shown in a utilized state, according to the preferred embodiment of the present device is disclosed. The body-encompassing blanket 10 (herein also described as the "blanket") 10, provides a blanket-like covering with enhanced features, especially for use by a user 20 when sitting or lying down. The blanket 10 includes a blanket body which is manufactured from textile 15. The blanket body is rectangular with a top edge, a bottom edge, and opposite lateral edges. The textile 15 may be of any natural, synthetic, or blend material. The use of any specific type of textile 15 is not intended to be a limiting factor of the present device. Additionally, the blanket 10 may be made in multiple sizes, colors, and styles, without regard to any limitation. The blanket 10 would be made in sizes to fit users 20, from full-size adults to small children.

In FIG. 1, the user 20 is wearing the device while standing upright. While such a position is possible while wearing the blanket 10, the preferred usage would be in a seated or reclined position such as experienced in a chair, rocker, sofa, bed, or the like. The use of the blanket 10 in any specific orientation is not intended to be a limiting factor of the present device. All hems 25 would be provided with a clean finish that folds inward, with a top needle stitch to be added, thus producing a neatly folded design with a clean finish to be created. As the user 20 applies, or puts on, the blanket 10, they would step through a waist opening 30, thus producing a lower panel 35 as well as a two-part upper front panel 40. The upper front panel 40 also provides for two (2) loose-fit sleeves 45 with overlock stitching to be added inside of any interior seams. The lower panel side seams 50 would also be provided with overlocking stitching. The lower panel lower seam 55 would be provided with a clean finish box cut at the lower hem.

Figure 2:
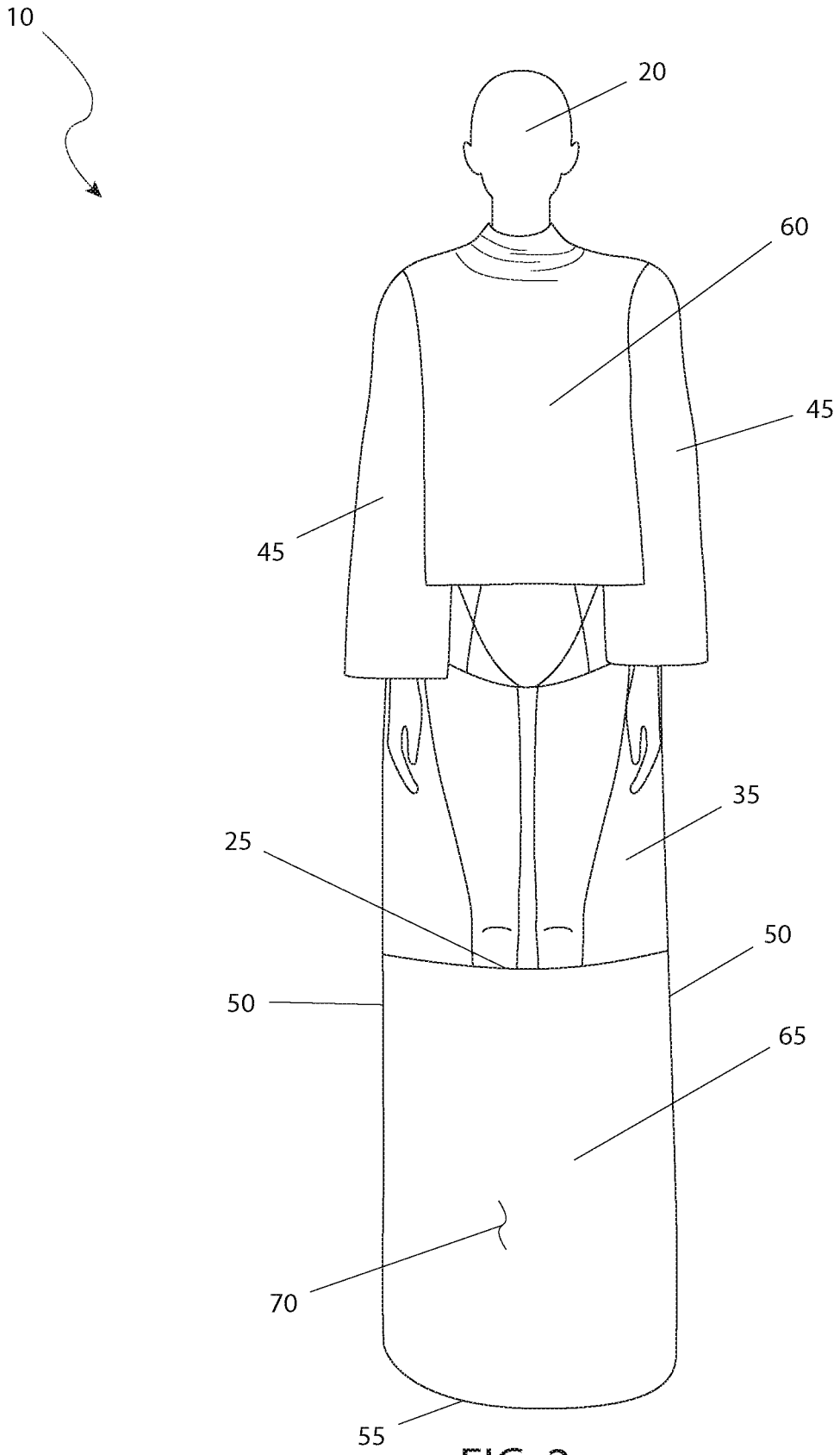
FIG. 2 is a rear view of the body-encompassing blanket 10, shown in a utilized state, according to the preferred embodiment of the present device.

Referring next to FIG. 2, a rear view of the blanket 10 shown in a utilized state, according to the preferred embodiment of the present device is depicted. In this figure, the blanket 10 provides the user 20 with a back panel 60, thus producing a connecting point for the two (2) sleeves 45. The lower panel 35 extends over the leg area of the user 20 and is also provided with a rear leg panel 65. The rear leg panel 65 is provided with upper hems 25, along with two (2) lower panel side seams 50 and a lower panel lower seam 55 both of which are as previously described. Such an arrangement of the lower panel 35 and the rear leg panel 65 produces a pocket 70 which encompass the lower legs of the user 20 thus keeping them warm. Thus, during the application process, the user 20 would first pass their body through the waist opening 30, bring the back panel 60 up and over their shoulders to produce the two (2) upper front panels 40 (as shown in FIG. 1), and place their arms into the sleeves 45 with the lower panel 35 across the front part of their legs. Next, the user 20 would place their legs into the pocket 70 formed by the lower panel 35 and the rear leg panel 65, thus completely encompassing their body with the exception of their head, buttocks and rear surface of their thighs as shown.

Figure 3:
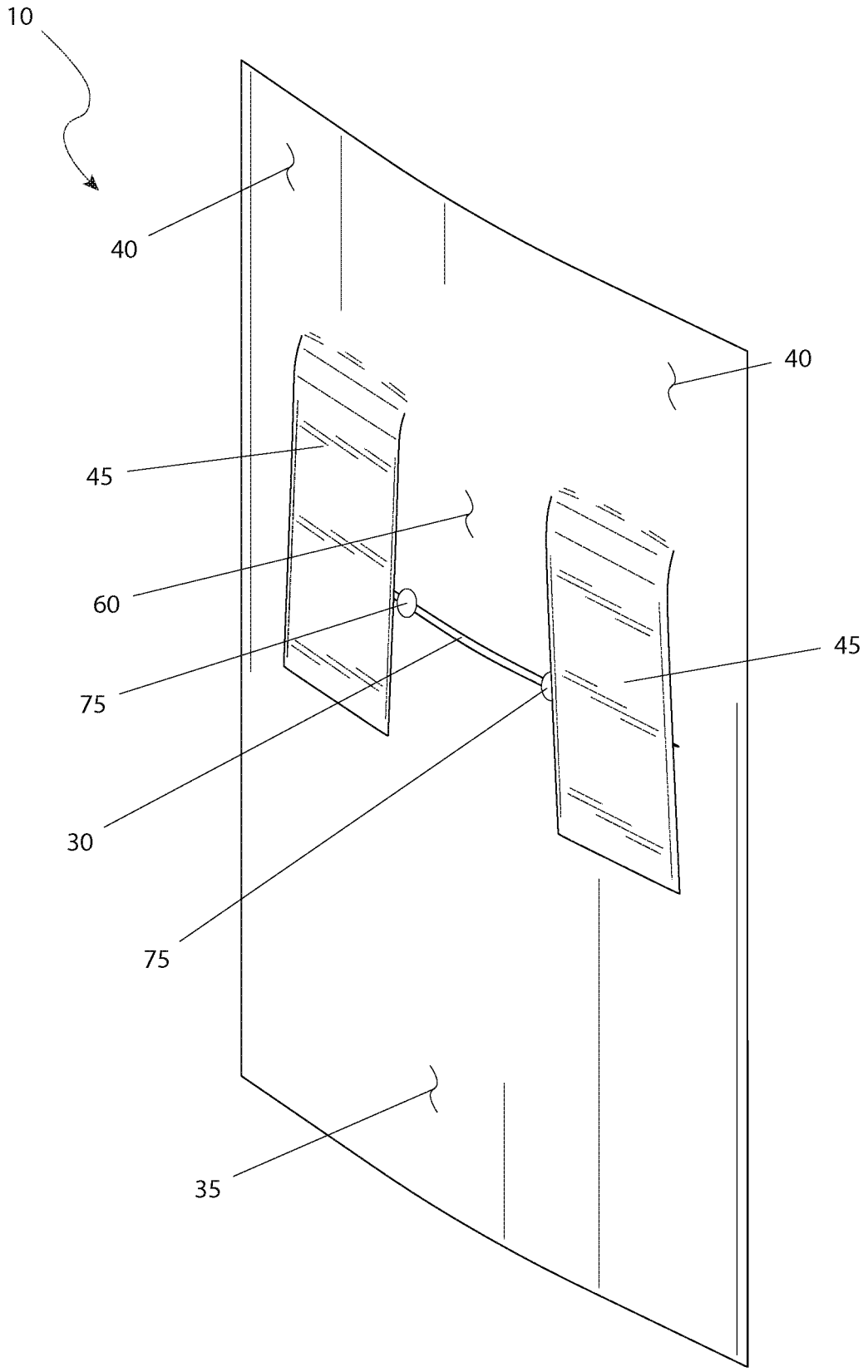
FIG. 3, is a front perspective view of the body-encompassing blanket 10, according to the preferred embodiment of the present device.

Referring now to FIG. 3, a front perspective view of the blanket 10 according to the preferred embodiment of the present device is shown. This view discloses the overall rectangular format of the blanket 10, thus leading to its configuration. This configuration is envisioned to provide for easy folding and storage of the blanket 10 when not in use. The lower panel 35 is located at the lower portion of the blanket 10 below the back panel 60 and separated by the waist opening 30. The waist opening 30 is provided with at least two (2) closure means 75 such as buttons (as shown), or snaps, hook-and-loop-type fasteners, or the like. The use of any specific type of closure means 75 is not intended to be a limiting factor of the present device. The closure means 75 allow for adjustment in size of the waist opening 30 to accommodate users of different sizes, while still producing a snug fit. The upper front panels 40 are visible at the upper outer corners of the blanket 10 as would be placed around the shoulders of the user 20 (as shown in FIGS. 1 and 2) with the two (2) sleeves 45 at an appropriate location for placement of the arms of the user 20.

Figure 4:
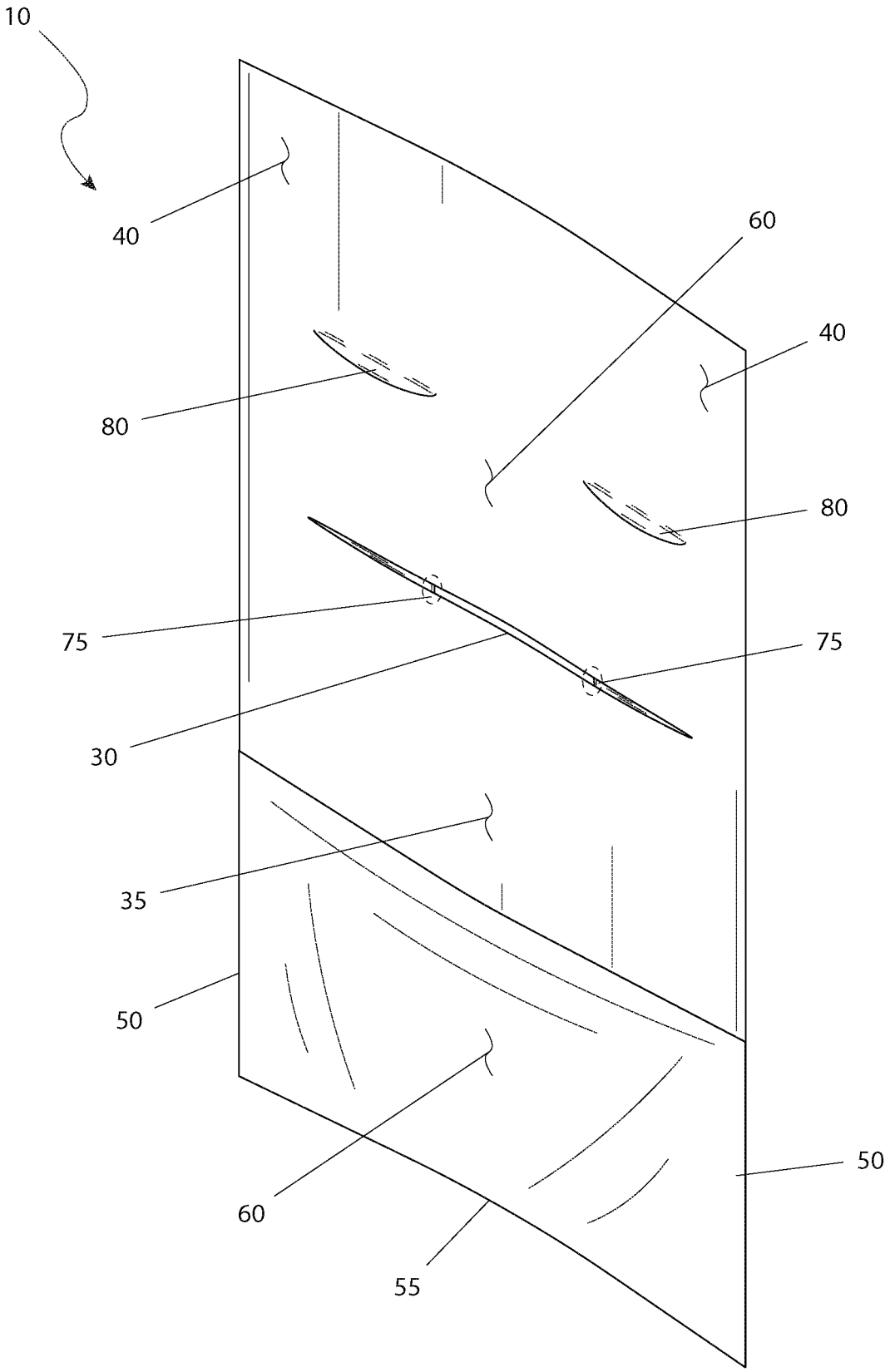
FIG. 4, is a rear perspective view of the body-encompassing blanket 10, according to the preferred embodiment of the present device.

Referring next to FIG. 4, a rear perspective view of the blanket 10 according to the preferred embodiment of the present device is disclosed. As before, the lower panel 35 is located at the lower portion of the blanket 10, below the back panel 60 and separated by the waist opening 30. The closure means 75 are shown by dashed lines due to their hidden nature. The upper front panels 40 are visible at the upper outer corners of the blanket 10 as would be placed around the shoulders of the user 20 (as shown in FIGS. 1 and 2) with two (2) arm openings 80 at an appropriate location for placement of the arms of the user 20. The back panel 60 is attached to the lower panel 35 by use of the two (2) lower panel side seams 50 as well as the lower panel lower seam 55.

Figure 5:
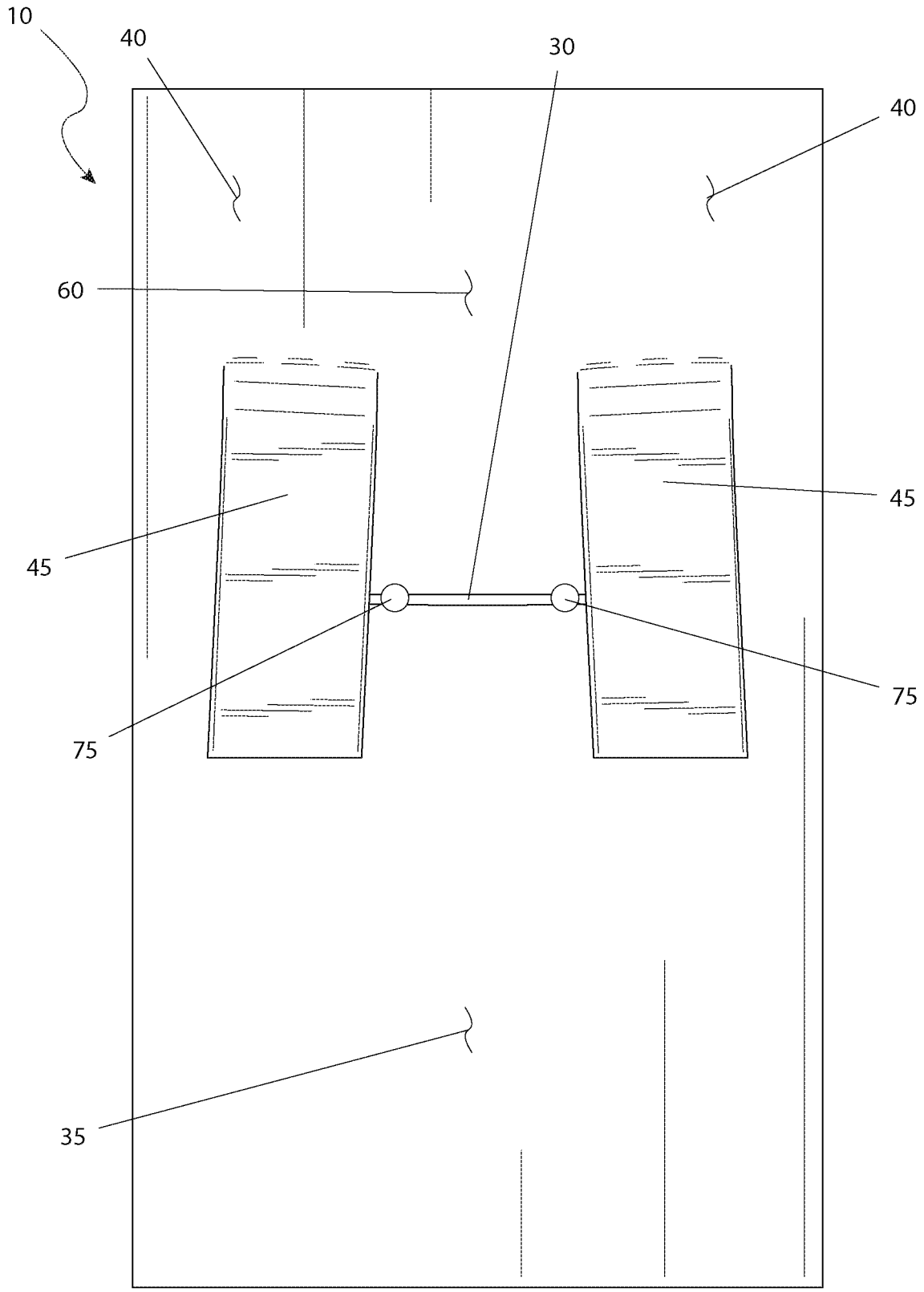
FIG. 5, is a front view of the body-encompassing blanket 10, according to the preferred embodiment of the present device; and, FIG. 6, is a rear view of the body-encompassing blanket 10, according to the preferred embodiment of the present device.

Referring now to FIG. 5, a front view of the blanket 10 according to the preferred embodiment of the present device is depicted. This figure discloses the overall rectangular configuration of the blanket 10. As aforementioned described, the exact size of the blanket 10 may vary. However, for purposes of illustration, it is envisioned that an approximate size for an adult would be one-hundred-fifty centimeters (150 cm.) in width and two hundred fifty centimeters (250 cm.) in height. An approximate size for a child would be ninety centimeters (90 cm.) in width and one-hundred-ninety centimeters (190 cm.) in height. The lower panel 35 is located at the lower portion of the blanket 10, below the back panel 60 and as separated by the waist opening 30. At least two (2) closure means 75 are provided along the waist opening 30 arranged in a symmetrical nature. The upper front panels 40 are visible at the upper outer corners of the blanket 10 as would be placed around the shoulders of the user 20 (as shown in FIGS. 1 and 2) with the two (2) sleeves 45 at an appropriate location for placement of the arms of the user 20.

Figure 6:
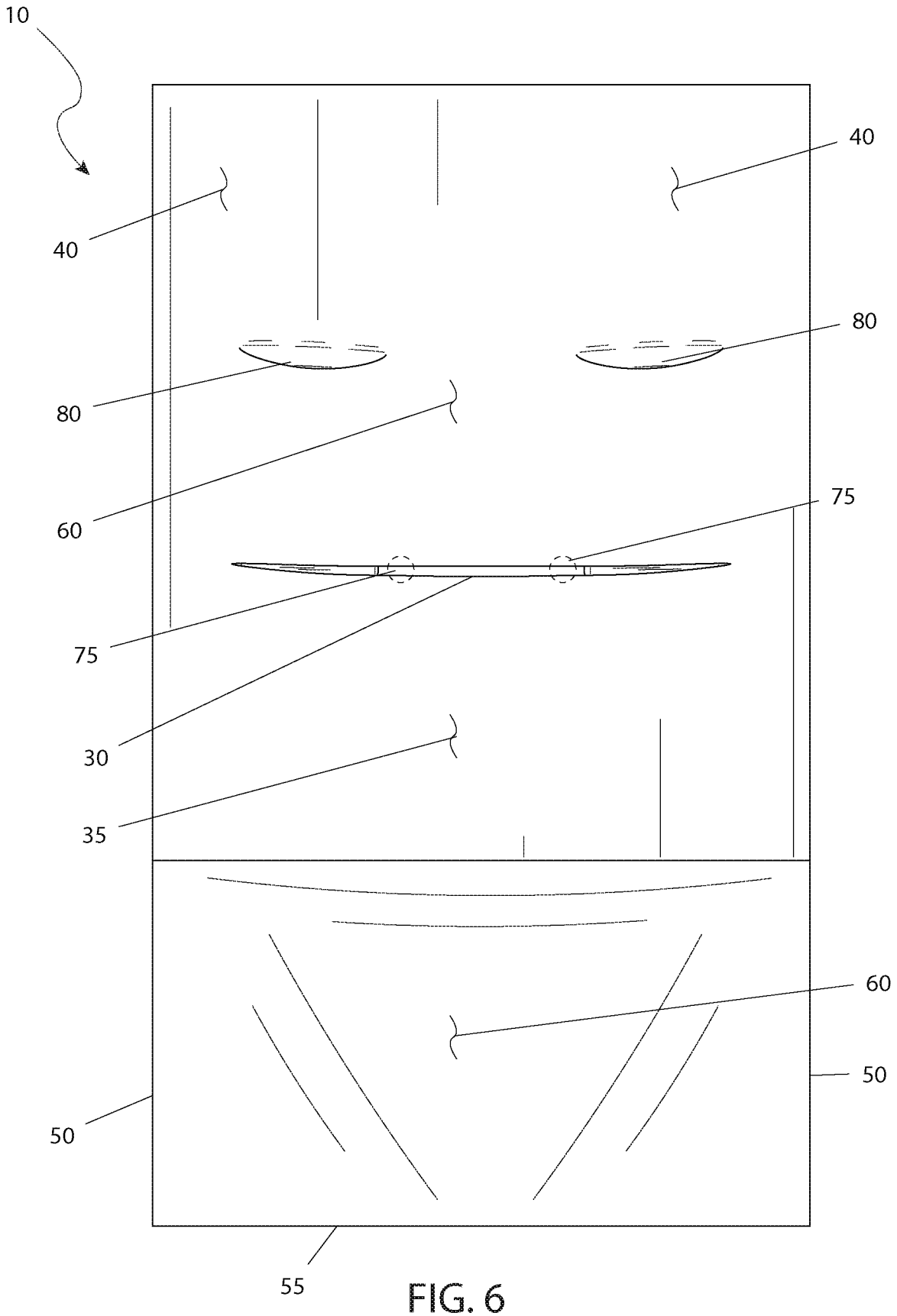

Referring to FIG. 6, a rear view of the blanket 10 according to the preferred embodiment of the present device is shown. As before, the lower panel 35 is located at the lower portion of the blanket 10, below the back panel 60 and as separated by the waist opening 30. The closure means 75 are shown by dashed lines, due to their hidden nature. The upper front panels 40 are visible at the upper outer corners of the blanket 10 as would be placed around the shoulders of the user 20 (as shown in FIGS. 1 and 2) with two (2) arm openings 80 at an appropriate location for placement of the arms of the user 20. The back panel 60 is attached to the lower panel 35 by use of the two (2) lower panel side seams 50 as well as the lower panel lower seam 55.

2. Operation of the Preferred Embodiment

The preferred embodiment of the present device can be utilized by the common user in a simple and effortless manner with little or no training. It is envisioned that the blanket 10 would be constructed in general accordance with FIG. 1 through FIG. 6. The user 20 would procure the blanket 10 from conventional procurement channels such as bedding stores, linen stores, home good stores, discount stores, department stores, mail order and internet supply houses and the like. Special attention would be paid to the overall size of the blanket 10, such as adult or child sizes, as well as material of construction, color, style, and the like.

During utilization, the user 20 would place the blanket 10 in a generally planar configuration. The user 20 would place the blanket 10 over their head or over their feet such that the waist opening 30 is over the waist of the user 20. Any closure means 75 would be utilized to allow for proper fit as required. The back panel 60 would then be brought up and across the back area of the user 20. The user 20 would simultaneously pass their arms through the arm openings 80 and into the sleeves 45 while bringing the two (2) upper front panels 40 up and over their shoulders. While in a seated or reclining position, the user 20 would lift their legs and feet, either sequentially or simultaneously, into the pocket 70 formed by the lower panel 35 and the back panel 60. This placement and arrangement of the blanket 10 upon the body of the user 20 produces a loose but comfortable fit that is perfect for relaxing and keeping warm without binding.

After use of the blanket 10, it may be removed, folded, stored, washed, dried, or undergo any process typical of a blanket that is used to keep warm. It is then ready for re-use in a repeating manner consistent with the above description on a cyclical basis.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A body-encompassing blanket, comprising:

a rectangular blanket body formed from a textile and having a front side, a rear side, a lower portion, an upper portion, a top edge, a bottom edge, and opposite lateral edges;

a lower panel disposed in the lower portion of the blanket body and configured, when the blanket is worn by a user, to extend across a front of lower legs of the user;

a back panel disposed in the upper portion of the blanket body and configured, when the blanket is worn by the user, to extend upwardly from a waist region of the user across a back of the user;

a waist opening extending transversely across the blanket body between the lower panel and the back panel and sized to receive a torso of the user;

a pair of upper front panels extending from opposite sides of the back panel and configured to be positioned over shoulders of the user when the user is wearing the blanket;

a pair of sleeves, each sleeve extending from a corresponding one of the upper front panels and each sleeve having interior seams with overlock stitching;

a rear leg panel located on the rear side of the blanket body and attached to the lower panel along a pair of lower panel side seams and along a lower panel lower seam, the rear leg panel and the lower panel together defining a pocket sized and positioned to receive and enclose lower legs and feet of the user while the blanket is worn, such that, in use, the blanket encompasses the body of the user with the exception of a head, buttocks, and rear surfaces of thighs of the user;

a pair of arm openings formed in the blanket body and aligned with the sleeves to permit passage of arms of the user into the sleeves;

a plurality of closure fasteners selected from buttons, snaps, and hook-and-loop fasteners attached along the waist opening and adjustable to vary a size of the waist opening to accommodate users of different body sizes while providing a snug fit at the waist; and, respective hems extending along the top edge, the bottom edge and the opposite lateral edges of the blanket body, the hems each having a folded clean finish with a top needle stitch, and the lower panel lower seam having a clean finish box cut at a lower hem of the respective hems of the lower panel.

2. A method for utilizing the body-encompassing blanket of claim 1, comprising:

first, placing the blanket in a flat, planar configuration;

second, the user stepping through the waist opening;

third, pulling the back panel over the shoulders of the user and aligning the upper front panels to one another;

fourth, inserting the arms of the user through the sleeves via the arm openings;

fifth, positioning the lower panel and the rear leg panel to encase a lower body of the user including the legs of the user within the pocket;

sixth, engaging the plurality of closure fasteners to adjust the fit of the blanket at the waist region of the user;

seventh, setting a non-restrictive fit of the blanket on the user; and, last, removing the blanket from the user, folding the blanket, and maintaining the blanket for repeated use of the blanket.

* * * * *